US005891263A

United States Patent [19]

Roof

[11] Patent Number: 5,891,263

[45] Date of Patent: Apr. 6, 1999

[54] DEPOSITS METHOD DISSOLVING COKE OVEN GAS

[76] Inventor: Glenn Roof, 13527 Wimbledon Dr., Sugar Land, Tex. 77478

[21] Appl. No.: 815,612

[22] Filed: Mar. 12, 1997

Related U.S. Application Data

[60] Provisional application No. 60/013,186, Mar. 12, 1996.

[51] Int. Cl. [6] ..... B08B 3/08; C23G 5/036

[52] U.S. Cl. ..... 134/22.14; 134/22.19; 134/39; 134/40; 510/264; 510/501

[58] Field of Search ..... 134/22.14, 22.19, 134/39, 40; 510/245, 264, 406, 500, 501

[56] References Cited

U.S. PATENT DOCUMENTS

| | | | |
|---|---|---|---|
| 3,966,589 | 6/1976 | Somekh | 208/321 |
| 4,108,681 | 8/1978 | Lawson et al. | 134/40 |
| 4,188,205 | 2/1980 | Fless | 75/42 |
| 4,509,989 | 4/1985 | Summansky | 134/22.14 |
| 4,664,786 | 5/1987 | Forte et al. | 208/356 |
| 5,225,002 | 7/1993 | Stafford et al. | 134/40 |

*Primary Examiner*—Jill Warden
*Assistant Examiner*—Saeed Chaudhry
*Attorney, Agent, or Firm*—Madan & Morris, PLLC

[57] ABSTRACT

The present invention provides a method of dissolving coke oven gas deposits comprising treating the deposits with a combination of a first amide and a second amide under conditions and at a ratio sufficient to dissolve a first amount of the deposit greater than a second amount of the deposit calculated based upon the proportional individual solvencies of the first amide and the second amide, wherein the first amide comprises N-methyl-2-pyrrolidinone.

18 Claims, No Drawings

DEPOSITS METHOD DISSOLVING COKE OVEN GAS

This application is a provision of Ser. No. 60/013,186 filed Mar. 13, 1996.

FIELD OF THE INVENTION

The present invention relates to methods and compositions for dissolving coke oven gas ("COG") deposits. More particularly, the invention relates to the use of a synergistic blend of N-methyl-2-pyrrolidinone (NMP) and a second amide, preferably dimethylformamide (DMF), to dissolve COG deposits.

BACKGROUND OF THE INVENTION

Metallurgical coke is produced from coal in a coke oven. The coking process involves the destructive distillation of a complex carbonaceous material. The compounds formed or driven off during the coking process have a wide range of boiling and melting points and solubilities. As a result, selective condensation or crystallization of the compounds with higher boiling points occurs, with consequent plugging of transmission lines, resulting in poor flow and all of the associated difficulties and dangers.

The gas transmission lines carrying coke oven gas can have up to 50% of their cross sectional area blocked by deposition due to (a) the dropping out of organic constituents, or (b) inorganic corrosion products formed by the hydrogen sulfide, cyanide, or thiocyanate contained in the gas acting on the metal piping. Where blast furnace gas is mixed with coke oven gas, iron oxide or other inorganic particles contribute to the reaction that results in corrosion products. Coke oven gas also is usually saturated with naphthalene and other readily sublimable hydrocarbons, such as anthracene and phenanthrene, and droplets of coal tar are almost always carried along throughout the gas system.

Deposits usually form at points of minimum velocity, or at sites of maximum surface to volume ratio, such as burner nozzles and orifice pins. The presence of these deposits limits the gas flow through the mains and can increase the pressure drop across the transmission distribution lines. As a result, proper distribution of the gas can be hindered. The hindrance is especially important for the underfiring system for heating coke ovens or for proper flame temperature control in boilers or reheating furnaces. A particular problem is plugging of the refractory-lined standpipes and goosenecks leading to the horizontal collecting main, which conducts the volatile products to the chemical recovery plant.

A method to prevent plugging of such lines during the refining of coke would be very desirable. One method that has met with success is the introduction of very powerful solvents into the system to dissolve and disperse the deposits. The solvent tends to liquify the deposits, with the liquid being removed from the line through a drip-leg. A most successful product that is used for this purpose contains the solvent N-methyl-2-pyrrolidinone (NMP). Unfortunately, NMP is an expensive solvent. A less expensive solvent system that would effectively prevent such plugging would be very desirable.

SUMMARY OF THE INVENTION

The present invention provides a method of dissolving coke oven gas deposits comprising treating the deposits with a combination of a first amide and a second amide under conditions and at a ratio sufficient to dissolve a first amount of the deposit greater than a second amount of the deposit calculated based upon the proportional individual solvencies of the first amide and the second amide, wherein the first amide comprises N-methyl-2-pyrrolidinone.

DETAILED DESCRIPTION OF THE INVENTION

The solvent of the present invention comprises a mixture of between about 10–90 wt % of NMP and between about 10–90 wt % of a second amide having the following general structure:

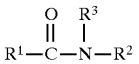

wherein $R^1$ is selected from the group consisting of hydrogen, aryl groups, and alkyl groups having between about 1–3 carbon atoms, and wherein $R^2$ and $R^3$ independently are selected from the group consisting of hydrogen, aryl groups and alkyl groups having between about 1–2 carbon atoms. Preferably, $R^2$ and $R^3$ are the same, and are selected from the group consisting of hydrogen and methyl groups. Suitable second amides include, but are not necessarily limited to dimethylformamide, N,N-dimethylacetamide, N,N-dimethylpropionamide, acetamide, formamide, propionamide, and butyramide. A preferred second amide is dimethylformamide (DMF).

In a preferred embodiment, the amount of N-methyl-2-pyrrolidinone is minimized to the lowest amount possible while still achieving synergism—that is, the dissolution of an amount of the deposit greater than an amount calculated based upon the proportional individual solvencies of the N-methyl-2-pyrrolidinone and the second amide. The amount of the less expensive second amide preferably is maximized in order to minimize cost.

A preferred formulation includes between about 1–10 wt % of a dispersant, preferably Hypermer SC™, a nonionic surfactant mixture available from ICI, Wilmington, Del., and between about 1–70 wt % of a supplemental solvent, preferably a solvent that is less expensive than the active NMP and/or second amide. Suitable supplemental solvents include, but are not necessarily limited to, heavy aromatic naphtha and mixtures of alkyl-substituted aromatics. A preferred supplemental solvent is FINA SOLV 150™, available from Fina Oil and Chemical Company.

When a supplemental solvent and/or dispersant is included, the resulting mixture should contain between about 15–35% of NMP, between about 35–55% of a second amide, and between about 5–50% of the supplemental solvent. In a preferred embodiment, the mixture comprises: about 25 wt % N-methyl-2-pyrrolidinone; about 45% dimethylformamide; about 26% FINA SOLV 150™ and about 4% of Hypermer SC™. NMP, other amide solvents, heavy aromatic naphtha, mixtures of alkyl-substituted aromatics, and nonionic surfactants may be obtained from a number of commercial sources.

In order to use the present invention, the mixture should be injected into the gas flow from coke ovens, preferably by aspiration or atomization, into: plugged or partially plugged gas flow lines; gas transfer lines where gas is used as fuel; low pressure compressors (boosters and exhausters); and/or, various interconnecting piping where the gas is being transported to other locations in the plant for processing. The mixture also can be aspirated into the inlet of a heat exchanger (frequently called a pre-heater) which is just upstream of the underfiring main.

The invention will be better understood with reference to the following examples.

EXAMPLE 1

The relative solvency of the solvent system was measured by dissolving 1.00 g ($W_2$) of a pulverized deposit from the burning of West Virginia and Western Pennsylvania bituminous coal, weighed to 0.01 g, into a 2 oz bottle followed by 9.00 g of solvent. The bottle was capped and shaken for an appropriate amount of time (at least overnight, with some samples being shaken for 3½ days) on a wrist action shaker. A Millipore filter assembly was readied (using Whatman #40 or #1 paper or, if filtration was too slow, a higher porosity paper) and the equilibrated mixture was poured onto the filter pad while vacuum was applied. After most of the supernatant was passed through, the vacuum was released and a 100 $\mu$l sample of the filtrate was transferred to a 100 ml volumetric flask using a Drummond type pipette. The sample was diluted to 100 ml using NMP. Sometimes, further dilution was necessary in order to obtain an absorbance reading of 0.1–0.6 at 425 nm. For purposes of calculation, all absorbances were normalized to correspond to a dilution factor of 10,000. Thereafter, using a standard curve (prepared using either NMP or Candidate A from Example III), the % color bodies dissolved (solvency) was extrapolated.

TABLE I

| SOLVENT | RELATIVE SOLUBILITY[1] OF SOLUTE IN SOLVENT |
|---|---|
| NMP | 28.6%[2] |
| DMF | 27.6% |
| NMP/DMF = 50/50 | 34.9% |
| NMP/DMF = 25/75 | 31.0% |

[1]NMP standard curve used.
[2]Because of filtration problems, a reading of 20.7% (which is believed to be low), was substituted with previous number that was obtained without the filtration problem.

The table shows the relative solvency of four solvent systems at a solids loading of 43%. Unexpectedly, the combination of either 50/50 or 25/75 NMP/DMF had a higher relative solubility than NMP, alone. The combination of NMP and DMF therefore appears to be synergistic.

EXAMPLE 2

The procedure described in Example 1 was repeated using 50% loading (5 g of COG deposit in 5 g of solvent) in each sample. The results are shown in Table II:

TABLE II

| SOLVENT | SOLUTE IN SOLVENT (WT %) FIRST ANALYSIS | SOLUTE IN SOLVENT (WT %) DUPLICATE ANALYSIS |
|---|---|---|
| NMP | 44.0 | 42.5 |
| DMF | 33.3 | 35.0 |
| NMP/DMF = 50/50 | 46.6 | 41.7 |
| NMP/DMF = 25/75 | 43.8 | 43.2 |

The data in Table II is consistent with that in Table I, although the solubilities are higher. The reason for the higher solubility is that the solids loading was higher (50% as opposed to 43%). The relative solvencies are the same.

The NMP/DMF combinations unexpectedly have better relative solvency than the calculated average solvency if no synergism is assumed. Therefore, the combination of NMP/DMF has a synergistic effect; i.e., the combination is unexpectedly superior to either NMP or DMF, individually.

EXAMPLE III 1.0 g ($W_1$) each of COG deposits from the burning of Pennsylvania coal (sample 1) and Mexican bituminous coal (sample 2) was added to a ½ oz bottle followed by 4.0 g of solvent candidate. The bottle was placed in an oven at 60° C. (140° F.) for 3 hours. Twice during this three hour period, at 1 and 2 hours, the bottles were removed from the oven and shaken on a wrist-action shaker for 10 minutes, then returned to the oven. A filtration flask and funnel were heated in the oven at 60° C. (140° F.) for 1 hour prior to removing the samples.

After the 3 hour period elapsed, the samples and the filtration equipment were removed from the oven, and the samples rapidly were filtered by vacuum. The residue was washed with 10 ml of acetone and then dried in a vacuum oven for 2 hours at 100° C. (212° F.). After cooling, to room temperature, the residue was weighed ($W_2$). The amount of deposit dissolved was calculated as follows:

$$\%\ \text{deposit dissolved} = \frac{W_1 - W_2}{W_1} \times 100$$

The solvent candidates were the following:

| CANDIDATE A | CANDIDATE B |
|---|---|
| 70% NMP<br>26% Fina Solv-150<br>4% Hypermer SC ™ | 45% DMF<br>25% NMP<br>26% Fina Solv-150<br>4% Hypermer SC ™ |

The results are shown in Table III:

TABLE III

| SAMPLE | % DEPOSIT DISSOLVED[1] CANDIDATE A | % DEPOSIT DISSOLVED CANDIDATE B |
|---|---|---|
| 1 | 16.1%[2] | 24.07%[2] |
| 2 | 32.8%[2] | 36.1%[2] |

[1] $\frac{\text{wt of deposit dissolved}}{\text{wt of initial deposit}} \times 100$
[2]Average of 3 replicates.

Again, the formula containing the NMP/DMF combination unexpectedly performed better than the formula containing the NMP, alone. Therefore, the combination of NMP/DMF has a synergistic effect; i.e., the combination unexpectedly dissolves an amount of the deposit greater than the amount that would be calculated based upon the proportional individual solvencies of the NMP and DMF. A similar synergistic effect would be expected using other second amide solvents.

Persons of ordinary skill in the art will appreciate that many modifications may be made to the embodiments described herein without departing from the spirit of the present invention. Accordingly, the embodiments described herein are illustrative only and are not intended to limit the scope of the present invention.

I claim:

1. A method of dissolving a coke oven gas deposit comprising treating said deposit with a combination of a first amide and a second amide under conditions and at a ratio sufficient to dissolve a first amount of said deposit greater than a second amount of said deposit calculated based upon proportional individual solvencies of said first amide and said second amide, wherein said first amide comprises N-methyl-2-pyrrolidinone.

2. The method of claim 1 wherein said second amide has the following general structure:

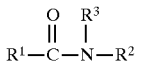

wherein $R^1$ is selected from the group consisting of hydrogen, aryl groups, and alkyl groups comprising between about 1–3 carbon atoms; and, wherein $R^2$ and $R^3$ independently are selected from the group consisting of hydrogen, aryl groups, and alkyl groups comprising between about 1–2 carbon atoms.

3. The method of claim 1 wherein $R^2$ and $R^3$ are the same, and are selected from the group consisting of hydrogen and methyl groups.

4. The method of claim 1 wherein said second amide is selected from the group consisting of dimethylformamide, N,N-dimethylacetamide, N,N-dimethylpropionamide, acetamide, formamide, propionamide, and butyramide.

5. A method of dissolving a coke oven gas deposit comprising treating said deposit with a combination of a first amide and a second amide under conditions and at a ratio sufficient to dissolve a first amount of said deposit greater than a second amount of said deposit calculated based upon proportional individual solvencies of said first amide and said second amide, wherein said first amide comprises N-methyl-2-pyrrolidinone and said second amide comprises dimethylformamide.

6. The method of claim 1 wherein said treating occurs during operation of said coke oven.

7. The method of claim 4 wherein said treating occurs during operation of said coke oven.

8. The method of claim 1 wherein said first amide comprises at least about 25% of said combination.

9. The method of claim 2 wherein said first amide comprises at least about 25% of said combination.

10. The method of claim 4 wherein said first amide comprises at least about 25% of said combination.

11. The method of claim 5 wherein said first amide comprises at least about 25% of said combination.

12. The method of claim 1 wherein said combination consists essentially of said first amide and said second amide.

13. The method of claim 2 wherein said combination consists essentially of said first amide and said second amide.

14. The method of claim 4 wherein said combination consists essentially of said first amide and said second amide.

15. The method of claim 5 wherein said combination consists essentially of said first amide and said second amide.

16. The method of claim 8 wherein said combination consists essentially of said first amide and said second amide.

17. The method of claim 1 wherein said combination comprises:

between about 15–35 wt % of said N-methyl pyrrolidinone;

between about 35–55 wt % of said amide; and, a material in an amount selected from the group consisting of between about 5–50 wt % of a solvent and between about 1–10 wt % of a dispersant.

18. A method of dissolving a coke oven gas deposit comprising treating said deposit with a combination of between about 15–35 wt % of a first amide, between about 35–55 wt % of a second amide and between about 5–50% of a material selected from the group consisting of a solvent, a dispersant, and a combination thereof, wherein:

said first amide comprises N-methyl-2-pyrrolidinone;

said second amide comprises dimethylformamide; and, said treating occurs under conditions and at a ratio of said first amide to said second amide sufficient to dissolve a first amount of said deposit greater than a second amount of said deposit calculated based upon proportional individual solvencies of said first amide and said second amide.

* * * * *

UNITED STATES PATENT AND TRADEMARK OFFICE

CERTIFICATE OF CORRECTION

PATENT NO. : 5,891,263

DATED : April 6, 1999

INVENTOR(S) : Glenn Roof

It is certified that error appears in the above-identified patent and that said Letters Patent is hereby corrected as shown below:

On the title page: Item [54] and Column 1, line 3, please replace "Deposits Method Dissolving Coke Oven Gas" with -- A Method of Dissolving Coke Oven Gas Deposits --.

Column 1, line 1, change "provision" with -- provisional --.

Column 1, line 2, replace "Mar. 13, 1996" with -- March 12, 1996 --.

Signed and Sealed this

Fourteenth Day of September, 1999

*Attest:*

Q. TODD DICKINSON

*Attesting Officer*

*Acting Commissioner of Patents and Trademarks*